United States Patent [19]

Toyama et al.

[11] 4,321,699

[45] Mar. 23, 1982

[54] WRIST WATCH WITH ALARM

[75] Inventors: Nobuo Toyama; Shigekazu Takahashi, both of Ena, Japan

[73] Assignee: Ricoh Watch Company, Limited, Aichi, Japan

[21] Appl. No.: 163,686

[22] Filed: Jun. 27, 1980

Related U.S. Application Data

[63] Continuation-in-part of Ser. No. 833,148, Sep. 14, 1977, abandoned.

[30] Foreign Application Priority Data

Sep. 17, 1976 [JP] Japan ..... 51-112200
Oct. 23, 1976 [JP] Japan ..... 51-142973

[51] Int. Cl.[3] ..... G04C 21/16
[52] U.S. Cl. ..... 368/255
[58] Field of Search ..... 368/72–74, 368/159, 250, 255; 310/334

[56] References Cited

U.S. PATENT DOCUMENTS

| | | | |
|---|---|---|---|
| 2,873,573 | 2/1959 | Simon | 368/250 |
| 3,733,804 | 5/1973 | Diersbock | 310/334 X |
| 3,777,472 | 12/1973 | Iiwuna | 368/225 |
| 3,788,060 | 1/1974 | Kaisamura | 368/255 |
| 3,940,255 | 3/1976 | Kasuda et al. | 368/255 |
| 4,045,954 | 9/1977 | Ganter et al. | 368/255 |

*Primary Examiner*—Vit W. Miska
*Attorney, Agent, or Firm*—Koda and Androlia

[57] ABSTRACT

A wrist watch with an alarm having a vibratory plate supported at a point inside the bottom housing of the wrist watch. The vibratory plate comprises a piezoelectric element, a base electrode fixed on one side of the element. Audible time sound is emitted through the bottom housing, which produces transmitted vibrations by the application of AC voltage to the piezoelectric element.

11 Claims, 7 Drawing Figures

WRIST WATCH WITH ALARM

CROSS-REFERENCE

This is a Continuation-in-part application of Ser. No. 833,148 filed Sept. 14, 1977, now abandoned.

BACKGROUND OF THE INVENTION

1. Field of the Invention

This invention relates to a wrist watch with an alarm, which emits audible time sound produced by a vibrating plate to be vibrated by applying AC voltage to a piezoelectric element forming vibratory plate.

2. Prior Art

In conventional wrist watches of this type, alarm sound is produced inside a watch case where a diaphragm having a piezoelectric element is mounted. Such wrist watches are hermetically constructed for water-proofing or dust-proofing. Consequently, the alarm sound produced inside the watch case is barely audible, in most cases.

The wrist watch, as shown in FIG. 1 for example, discloses a solution to this problem. In FIG. 1 a reference numeral 1 represents a watch case on which a threaded back cover 2 is mounted with an O-ring 3 given pressure therewith. The back cover 2 has some holes 2*a* for passing sound, said holes being made on the bottom face of the back cover, and a disk diaphragm 4 fixed on the inner stepped portion. The diaphragm 4 consists of a base electrode 4*a* fixed at the periphery on the back cover 2, a piezoeletric element 4*b* attached to the inner side of the base electrode 4*a* and an electrode 4*c* formed on the inner side of the piezoelectric element 4*b*. The electrode 4*c* is connected to a circuit board 6 through a resilient lead 5. The circuit board 6 is mounted on a movement 7 which is housed inside the watch case 1.

In such a wrist watch as shown in FIG. 1, the piezoelectric element 4*b* is vibrated when voltage is applied between the base electrode 4*a* and the electrode 4*c*, and a vibration or alarm sound is produced at the center of the diaphragm 4. Said alarm sound is transmitted to the outside through the holes 2*a*.

In the wrist watch shown in FIG. 1, it is certain that the alarm sound produced therein can be transmitted to the outside with less resistance. However, the wrist watch cannot be kept hermetic or water-tight because of the holes 2*a* for sound passage, and neither water nor dust can be prevented from entering the watch. Furthermore, such holes are undesirable from the viewpoint of good appearance.

Thus, the wrist watch shown in FIG. 2 is designed to overcome the above disadvantages. This wrist watch includes a piezoelectric element 14*b* attached directly to a back cover 12 as a base, an electrode 14*c* formed on the other side of the piezoelectric element 14*b*, said electrode 14*c* being connected to a circuit board 16 mounted on a movement 17 through a lead 15.

In the wrist watch shown in FIG. 2, the back cover 12 itself is vibrated so as to produce alarm sound. Consequently, said alarm sound can be transmitted to the outside without any obstacle. It is, however, difficult to generate a sound of a high amplitude due to the back cover 1, which is commonly made of stainless steel having high rigidity, and therefore, sufficient alarm sound cannot be produced.

Furthermore, in prior art wrist watches vibrations may occur at the center of a diaphragm, and a high driving voltage is required for producing sound of a high amplitude. Such a low driving voltage as employed in these wrist watches would not be good enough, resulting in poor acoustic conversion efficiency. In addition, a plate-like diaphragm can be vibrated with small amplitude due to its high spring constant in vibrations, and has a high characteristic frequency, which is disadvantageous. A thinner diaphragm has been suggested for eliminating this drawback; however, this may result in cracking the piezoelectric element fixed on the base electrode and reducing the strength of the diaphragm itself unfavorably.

SUMMARY OF THE INVENTION

A primary object of the present invention is to provide a wrist watch with an alarm which permits emission of sufficient alarm sound with small power consumption by virtue of high acoustic conversion efficiency.

Another object of the present invention is to provide a wrist watch with an alarm which is good in appearance, highly water-proof and dust-proof, and capable of producing reliable and sufficient alarm sound.

Still another object of the present invention is to provide a wrist watch with an alarm where the exterior bottom housing vibrates by itself with the result of a compact and simple structure.

Yet another object of the present invention is to provide a wrist watch with an alarm where no sound outlet opening is needed allowing improved durability.

BRIEF DESCRIPTION OF THE DRAWINGS

FIG. 1 is a cross-sectional view in part of a wrist watch which is provided with some holes for passing sound on the back cover; and FIG. 2 is a cross-sectional view in part of a wrist watch which has a piezoelectric element attached directly to the back cover.

FIG. 3 is a cross-sectional view in part of a wrist watch as one embodiment, which has a vibratory plate fixed on a projection formed on the bottom housing;

FIG. 4 is a cross-sectional view of a fixing portion, as an example, where a vibratory plate is fixed on the back cover through a spacer; and FIG. 5 is a cross-sectional view of a fixing portion as another example, where a vibratory plate is fixed at a point in contact with the bottom housing.

FIG. 6A being a plan view of a part of an alarm in a wrist watch; and

FIG. 6B being a vertical sectional view of the alarm taken diametrically.

DETAILED DESCRIPTION OF THE INVENTION

Figure 1:
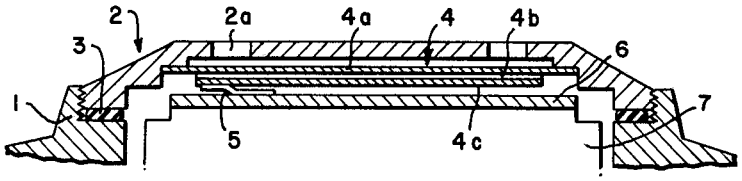
FIGS. 1 and 2 show conventional wrist watches with an alarm.
Figure 2:
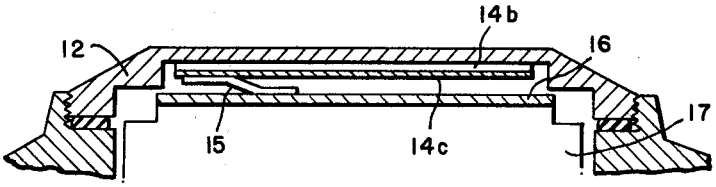
Figure 3:
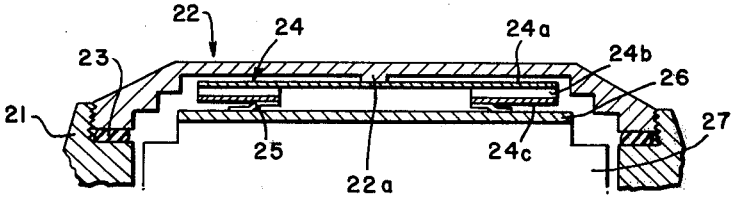
FIGS. 3 through 5 show some embodiments of the present invention.

In FIG. 3, reference numeral 21 represents a watch case on which a threaded bottom housing 22 is mounted. An O-ring 23 is provided for water-proof and dust-proof use between the watch case 21 and the bottom housing 22, said O-ring being under pressure therebetween. The bottom housing 22 has a projection 22*a* formed at the center inwardly, and a vibratory plate 24 is fixed to the projection 22*a*. The vibratory plate 24 is attached by spot welding or screws. The vibratory plate 24 thus attached consists of a base electrode 24*a* fixed at the center of the projection 22*a*, a piezoelectric element 24*b* attached to the inner side of the base electrode 24*a* with adhesive or the like, leaving its central portion open, and an electrode 24*c* formed on the inner side of the piezoelectric element 24*b*, said electrode 24*c* being connected to a circuit board 26 through a resilient lead 25. This connection may be made by soldering a commonly used lead wire. The circuit board 26 is mounted on a movement 27 in a conventional manner, said movement being housed in the watch case 21.

In short, the plate 24 of the present invention comprises the piezoelectric element 24*b*, the base electrode sheet 24*a* provided at one side of the element 24*b* and the electrode 24*c* attached to the other side of the element 24*b* by evaporation, etc. The base electrode sheet 24*a* also works as a weight sheet for the relatively light weight piezoelectric element 24*b* so that the vibration of the vibratory plate 24 may be transmitted better to the exterior bottom housing 22.

With such an arrangement of the wrist watch shown in FIG. 3, ground potential is applied to the base electrode 24*a* through movement 27, watch case 21 and bottom housing 22, while driving potential is applied to the electrode 24*c* from the circuit board 26 through the resilient lead 23. As a result of alternate application of voltage between the base electrode 24*a* and the electrode 24*c*, the piezoelectric element 24*b* is oscillated. Such osillations are transmitted to the bottom housing 22 through the projection 22*a*, and audible time signals are produced from the bottom housing 22.

In other words, the base electrode sheet 24*a* is fixed to the inner face of the above-mentioned plaen of the exterior bottom housing 22 and is supported by the plane at a single point. Thus the vibration of the vibratory plate 24 with now considerably heavy weight is transmitted to the plane of the exterior bottom housing 22 to vibrate the plane to generate an alarm.

In the embodiment of FIG. 3, the projection 22*a* is formed on the bottom housing 22. It may be formed on the base electrode 24*a*, which is fixed on the bottom housing 22.

Figure 4:
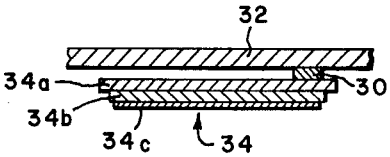

Furthermore, as illustrated in FIG. 4, a vibratory plate 24 may be fixed on a back cover 32 via a spacer 30. In FIG. 4 a reference numeral 34*a* represents a base electrode, 34*b* a piezoelectric element and 34*c* an electrode.

Figure 5:
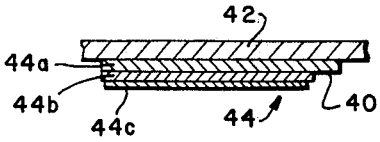

In addition, as illustrated in FIG. 5, a vibratory plate 44 may be fixed at a single point 40 by spot welding in contact with a back cover 42. In FIG. 5 a reference numeral 44*a* represents a base electrode, 44*b* a piezoelectric element and 44*c* an electrode.

In the embodiments shown in FIGS. 3 through 5, there is no description of the shape of these vibratory plates, which may be rectangular or in any other form.

In accordance with the teachings of the present invention, a vibratory plate is fixed at one point on the bottom housing of a wrist watch. This makes mounting work quite easy and assembling work simplier. Furthermore, the alarm sound can be produced efficiently even through a bottom housing of high rigidity by the effect of oscillations as if produced by a tuning fork controlled oscillator formed of the bottom housing and a vibratory plate integral therewith. Additionally, the piezoelectric elements may be damaged less frequently by handling such elements together with base electrodes having them attached thereto.

Figure 6A:
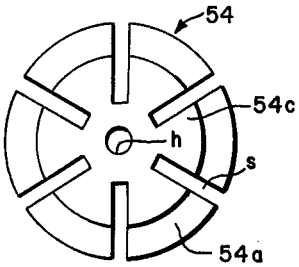
FIGS. 6A and 6B show still another embodiment of the present invention.
Figure 6B:
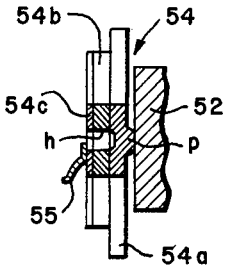

In FIGS. 6A and 6B reference numeral 54 represents a vibratory plate which consists of a piezoelectric element 54*b*, a base electrode 54*a* and an electrode 54*c*. The base electrode 54*a* is fixed on one side of the piezoelectric element 54*b* having a hole h at the center of the element like a disk, for example. The base electrode 54*c* is a disk which is larger in diameter than the piezoelectric element 54*b*, and has a projection p which extends in a direction opposite to the piezoelectric element 54*b*. The projection p is formed in alignment with the hole h on the piezoelectric element 54*b* so as to be spot welded on the bottom housing 52, to be described hereinafter. The electrode 54*c*, which is formed on the other side of the piezoelectric element 54*b* is a thin layer of silver evaporated thereon, for example, is connected to a lead wire 55 from a a power source (not shown).

The vibratory plate 54, thus constructed, has a plurality of slits which extend radially from the middle of the radius to the periphery in such a manner as to divide the vibratory plate 54 into like sections. Thus, the vibratory plate 54 has a plurality of fan-like sections separated from each other.

The projection p formed at the center of the vibratory plate 54 is fixed on the back cover 52. This is done by spot welding, for example, which applies a high energy to portions to be adhered for melting and bonding them. Two electrodes are required for spot welding, for which the hole h is provided on the piezoelectric element 54*b* for insertion. The vibratory plate 54 may also be fixed to the bottom housing 52 with an adhesive.

The vibratory plate 54 is vibrated by causing the piezoelectric element 54*b* to be strained periodically with AC voltage applied between the base electrode 54*a* and the electrode 54*c* holding the element therebetween. The vibratory plate 54 has a low intrinsic frequency of a high amplitude, retaining a large vibratory area which is divided into fan-shaped sections by radially extending the slits s.

As has been described heretofore, the present invention permits generation of vibrations of a high amplitude by means of a vibratory plate fixed at a single point on the inner side of the bottom housing of a wrist watch, said vibratory plate being divided into like sections by slits, with high acoustic efficiency obtained by small energy. This is very advantageous, particularly in electronic wrist watches where the power supply is quite small. In addition, fixing the vibratory plate at one point on the bottom housing prevents the plate from being damaged when any external force is imparted to the bottom housing, and makes it very easy to mount the plate thereon in the assembly of watch parts and elements.

It is preferable to produce an alarm sound whose pulse recurrence frequency is in a range of 1KHz to 4KHz, which would be most easy for users to hear. A vibrating system is naturally set for a resonance frequency between 1KHz and 4KHz.

We claim:

1. A wrist watch with alarm means for producing alarm sound by a vibratory plate formed of a piezoelectric element strained with AC voltage applied thereto for generating vibrations, said piezoelectric element having a base electrode attached to one side thereof and other electrodes attached to the other side thereof in such a manner as to form the vibratory plate, said vibratory plate being fixed at a single point on the inner side of a central plane portion of an exterior bottom housing of the wrist watch, thereby the vibration of said vibratory plate being transmitted to said bottom housing.

2. A wrist watch with alarm means as claimed by claim 1, wherein ground potential is applied to the base electrode through the bottom housing while driving potential is applied to the other electrode formed on the other side of the piezoelectric element and connected to a circuit board, so that vibrations are produced therebetween.

3. A wrist watch with alarm means as claimed by claim 1, wherein the vibratory plate is fixed directly on the bottom housing.

4. A wrist watch with alarm means as claimed by claim 1, wherein the vibratory plate is fixed on the bottom housing through a spacer.

5. A wrist watch with alarm means as claimed by claim 1, wherein the vibratory plate is fixed at a single point on the bottom housing by spot welding.

6. A wrist watch with alarm means as claimed by claim 1, wherein the said vibratory plate further being divided into sections by a plurality of slits provided radially and extending from the central portion to the periphery of the vibratory plate.

7. A wrist watch with alarm means according to claim 1, wherein said bottom housing further being provided with a central, inwardly projecting projection and said vibratory plate is fixed to said projection.

8. A wrist watch with alarm means according to claim 7, wherein said piezoelectric element of said vibratory plate has an open central portion.

9. A wrist watch with alarm means according to claim 8, wherein the frequency of said applied AC voltage is between 1KHz and 4KHz.

10. A wrist watch with alarm means according to claim 8, wherein said other electrode of said vibratory plate is coupled to a circuit board of wrist watch by a resilient lead.

11. A wrist watch with alarm means for producing alarm sound by a vibratory plate formed of a piezoelectric element strained with AC voltage applied thereto for generating vibrations, said piezoelectric element having a base electrode atached to one side thereof and an other electrode attached to the other side thereof in such a manner as to form the vibratory plate, said vibratory plate being fixed at a single point on the inner side of a central plane portion of an exterior bottom housing of the wrist watch, thereby the vibration of said vibratory plate being transmitted to said bottom housing wherein said vibratory plate is provided substantially in parallel with said bottom housing, and said vibratory plate is heavier than said bottom housing.

* * * * *